US006502981B2

(12) United States Patent
Haida

(10) Patent No.: US 6,502,981 B2
(45) Date of Patent: Jan. 7, 2003

(54) WATCH THAT CAN SERVE AS EITHER A WRISTWATCH OR A CLOCK

(75) Inventor: Shuichi Haida, Tokyo (JP)

(73) Assignee: Yugen Gaisha Tokima, Tokyo (JP)

( * ) Notice: Subject to any disclaimer, the term of this patent is extended or adjusted under 35 U.S.C. 154(b) by 23 days.

(21) Appl. No.: 09/755,892

(22) Filed: Jan. 4, 2001

(65) Prior Publication Data

US 2002/0085455 A1 Jul. 4, 2002

(51) Int. Cl.[7] ..... G04B 37/00; A44C 5/00
(52) U.S. Cl. ..... 368/276; 368/281; D10/32
(58) Field of Search ..... 368/45, 88, 276, 368/277, 278, 300; D10/33–35; D21/136, 150; 486/71–73, 76, 77, 487

(56) References Cited

U.S. PATENT DOCUMENTS

D285,417 S * 9/1986 Nakane ..... D10/33
D286,511 S * 11/1986 Wada ..... D10/35
D288,343 S * 2/1987 Ogawa ..... D21/144
D291,973 S * 9/1987 Doi ..... D10/33
5,540,367 A * 7/1996 Kauker ..... 224/269

* cited by examiner

*Primary Examiner*—Vit Miska
(74) *Attorney, Agent, or Firm*—Greer, Burns & Crain, Ltd.

(57) ABSTRACT

A watch main-body mounting seat 16, which is part of a watchband 14 of a watch 10 that can serve as either a wristwatch or a clock, has a circular hole 20 at the center. A notch-1 22 and a notch-2 24 are formed oppositely along the circumference of the seat hole 20. The back face of the watch main-body mounting seat 16 is provided with a guide groove-1 26 and a guide groove-2 28 extending counter-clockwise from the notch-1 22 and the notch-2 24, respectively. An engaging projection 30 and an engaging projection 32 are formed to protrude on the back face of the watch main body 12. An engaging tab-1 30A and an engaging tab-2 32A extend laterally from the end of the engaging projections 30 and the engaging projections 32, respectively. The watch main body 12 is provided with bases 44 and 46 and a ring 48.

2 Claims, 7 Drawing Sheets

WATCH THAT CAN SERVE AS EITHER A WRISTWATCH OR A CLOCK

FIELD OF THE INVENTION

The present invention pertains to watches, specifically those that can serve as either a wristwatch or a clock.

BACKGROUND OF THE INVENTION

A watch is composed of a main body and a watchband, and worn on the wrist of a person with the watchband. When you place a traditional watch on the surface of a table, etc., it is difficult to erect and keep it standing like a clock because of the obstruction of its watchband. Hence, traditional watches can be used only as a watch, but certainly not as a clock.

OBJECT OF THE INVENTION

It is an object of the present invention to overcome the difficulty mentioned in the above paragraph, so that a device can be used not only as a wristwatch, but also as a clock.

SUMMARY OF THE INVENTION

The device of the invention comprises a watch main body, a watchband detachable from the watch main body, and a base, which is part of the watch main body and allows it to remain firmly upright when the watchband is removed.

More specifically, the device comprises a watch main body; a watchband detachable from the watch main body; a watch main-body mounting seat, which is part of the watchband; a seat hole at the center of the mounting seat; a notch 1 and a notch 2, which are oppositely formed along the circumference of the seat hole; a guide groove 1 and a guide groove 2, which are formed along the circumference of the seat hole extending from the notch 1 and the notch 2, respectively; an engaging projection 1 and an engaging projection 2, which protrude from the back face of the watch main body and which enter into the notch 1 and the notch 2, respectively; an engaging tab 1 and an engaging tab 2, which form the end of the engaging projection 1 and the engaging projection 2, respectively, and are to be guided along the guide groove 1 and the guide groove 2, respectively; a base, which is part of the watch main body; and a ring provided on the watch main body.

The device may also comprise a watch main body; a watchband detachable from the watch main body; a watch main-body mounting seat, which is part of the watchband; a seat hole at the center of the mounting seat; a notch 1 and a notch 2, which are oppositely formed along the circumference of the seat hole; a guide groove 1 and a guide groove 2, which are formed along the circumference of the seat hole extending from the notch 1 and the notch 2, respectively; an engaging projection 1 and an engaging projection 2, which protrude from the back face of the watch main body and are to enter into the notch 1 and the notch 2, respectively; an engaging tab 1 and an engaging tab 2, which form the end of the engaging projection 1 and the engaging projection 2, respectively, and are to be guided along the guide groove 1 and the guide groove 2, respectively; and a base, which is part of the watch main body.

DESCRIPTION OF THE PREFERRED EMBODIMENTS

Turning now to the drawings, FIGS. 1 through 5 illustrate a first embodiment of the device of the invention, namely a watch that can serve as either a wristwatch or a clock.

Figure 1:
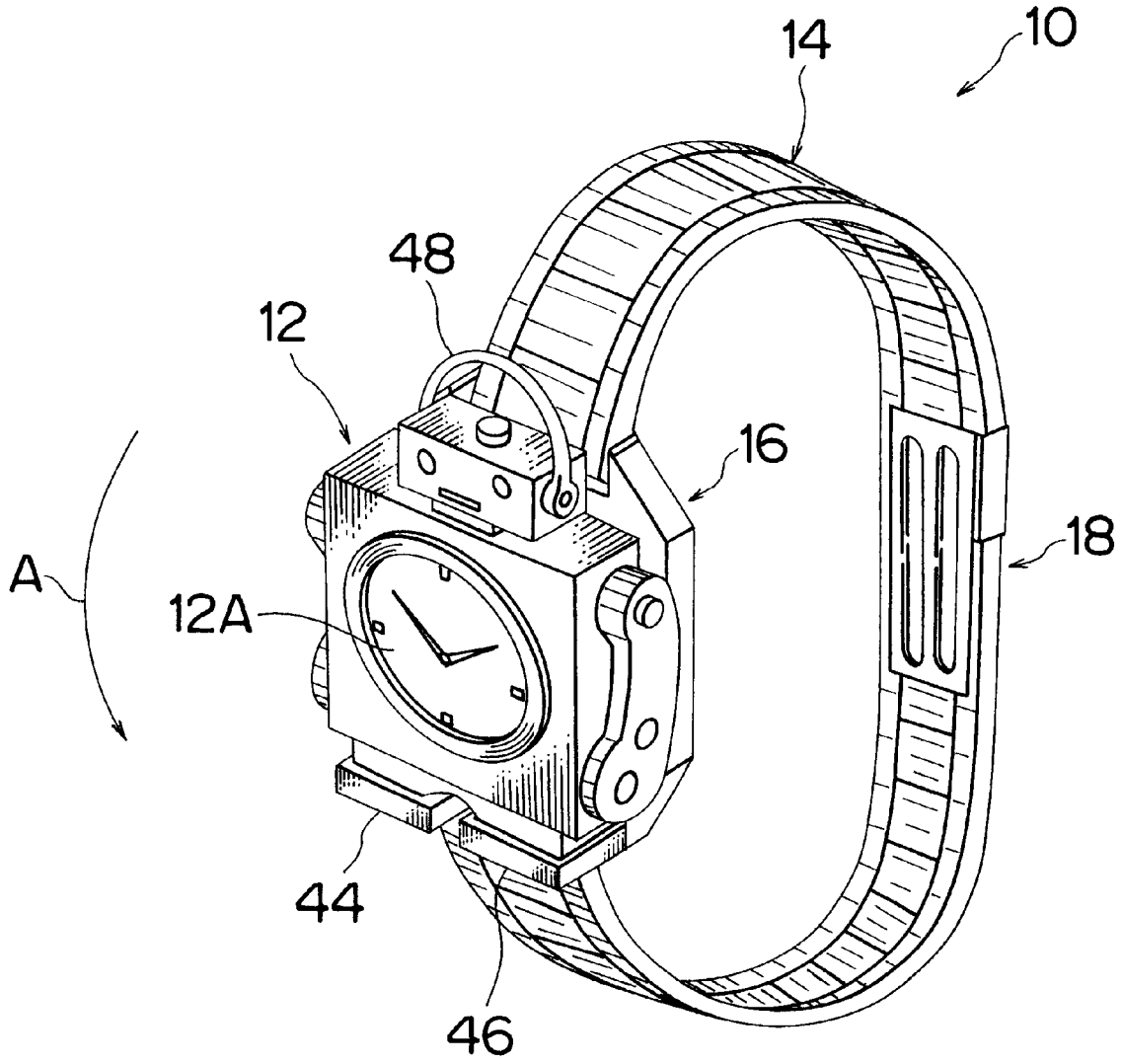
FIG. 1 is a perspective view of the entire watch that can serve as either a wristwatch or a clock in a first embodiment.
Figure 2:
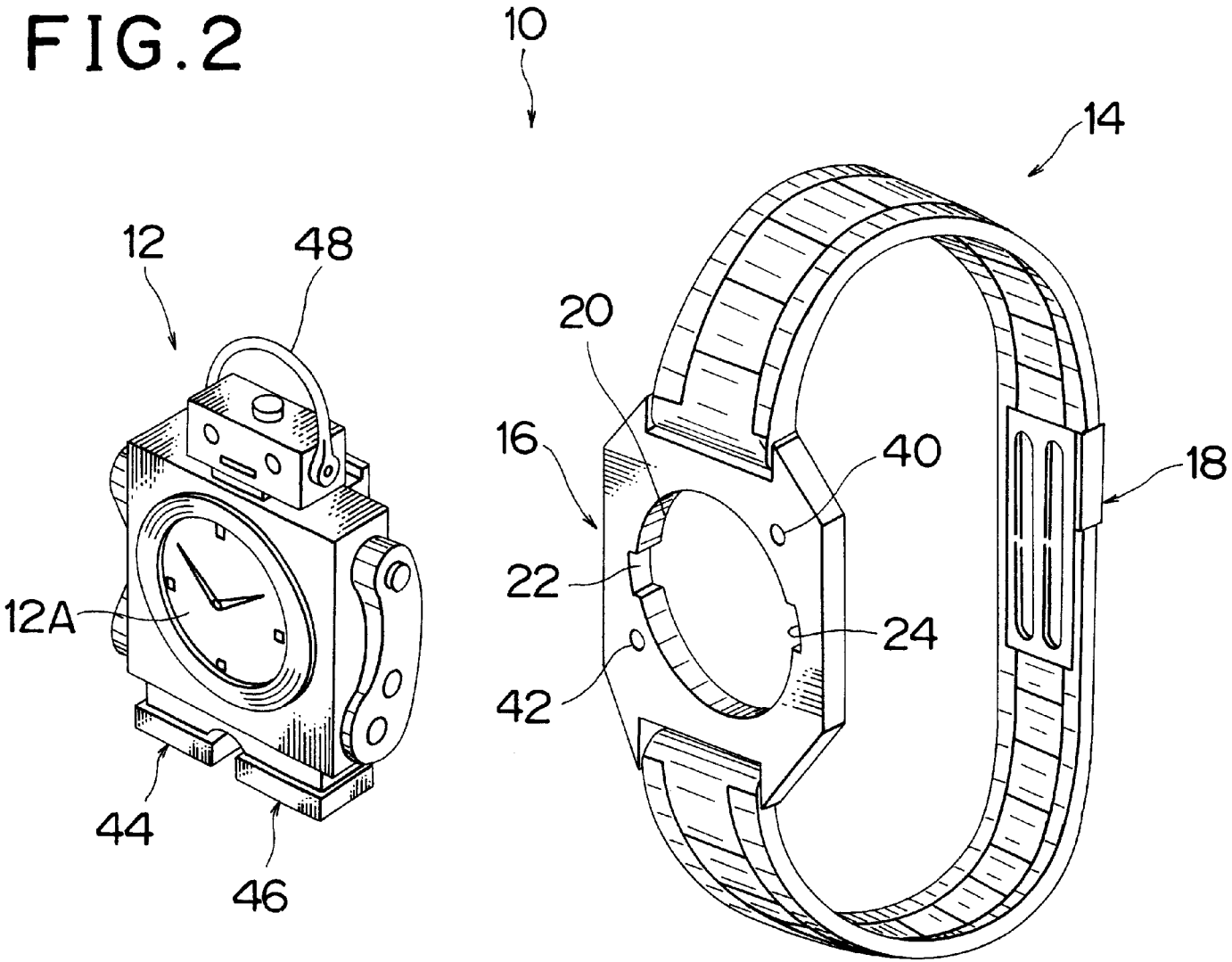
FIG. 2 is a perspective view of the watch that can serve as either a wristwatch or a clock with its watch main body and its watchband being separated in the first embodiment.

The watch 10 that can serve as either a wristwatch or a clock, as shown in FIGS. 1 and 2, comprises a watch main body 12, which is designed to mimic a robot, and a watchband 14 made of metal. The watch main body incorporates known clockworks for time keeping and time is displayed on its front face 12A. The watchband 14 is provided with a watch main-body mounting seat 16 and further with an adjuster 18 oppositely to the mounting seat 16.

Figure 3:
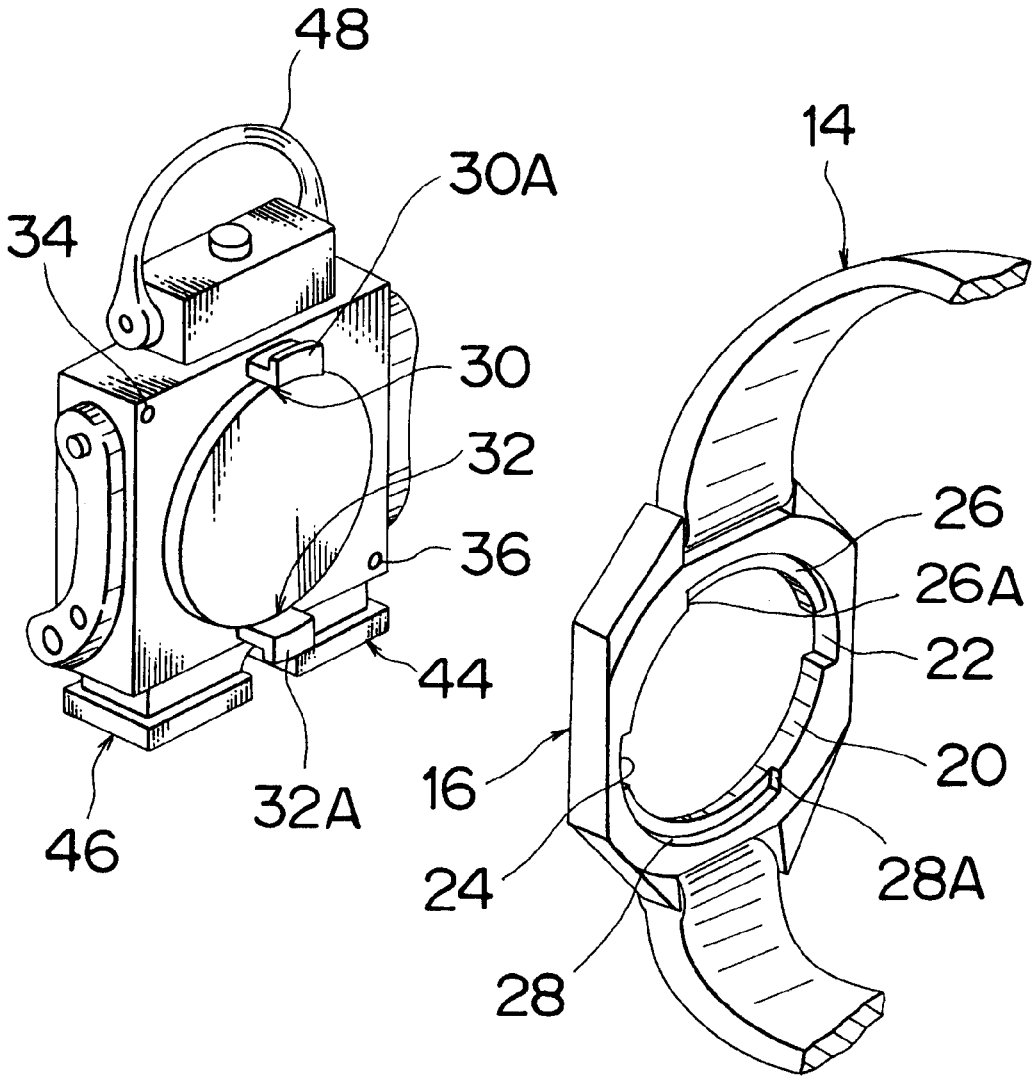
FIG. 3 is a perspective view, viewed from behind, of the watch main body and part of the watchband of the watch that can serve as either a wristwatch or a clock in the first embodiment.
Figure 4:
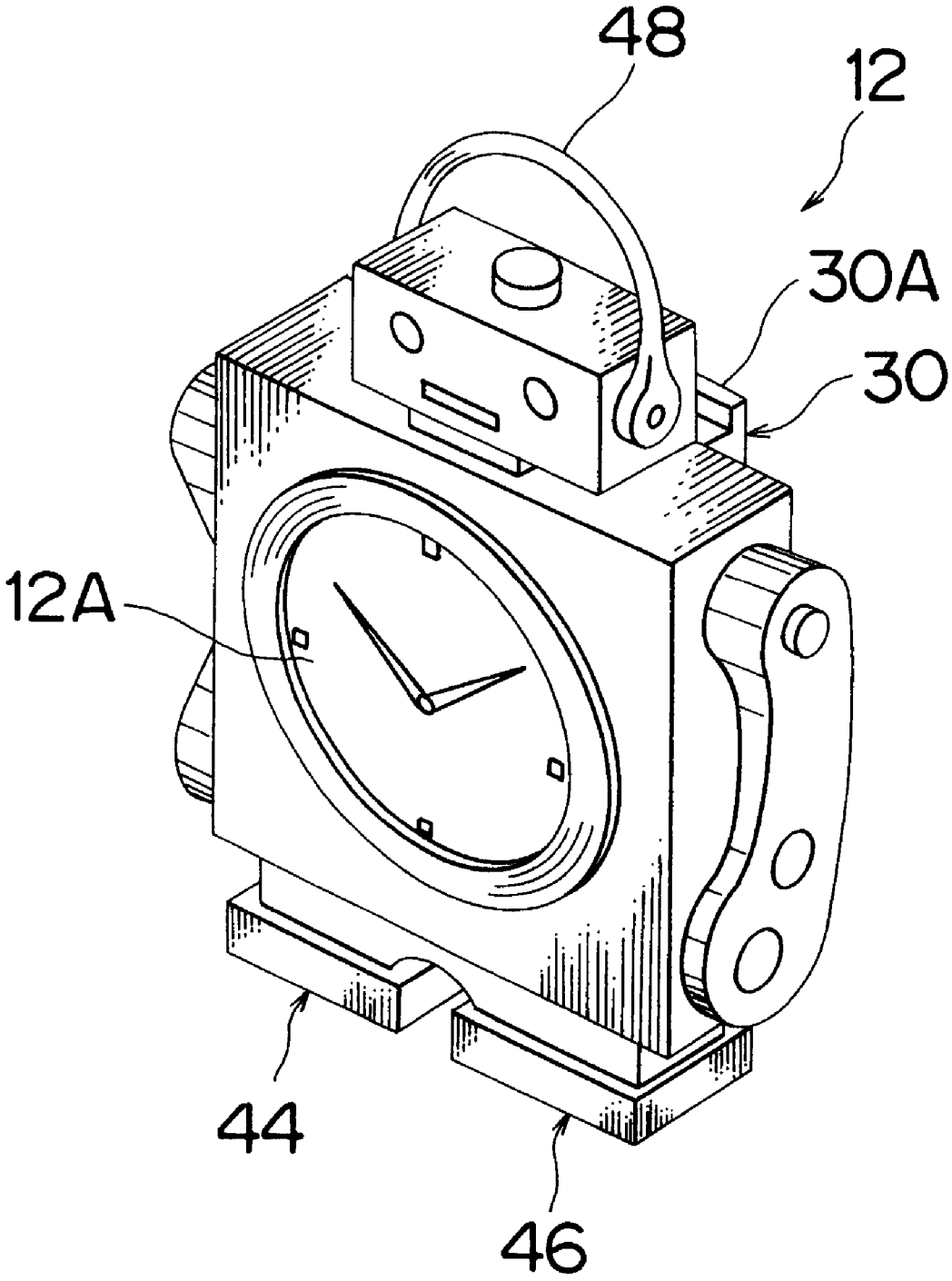
FIG. 4 is a perspective view of the entire watch main body of the watch that can serve as either a wristwatch or a clock in the first embodiment.

The watch main-body mounting seat 16 has a circular hole 20 at the center as shown in FIGS. 2 and 3. A notch-1 22 and a notch-2 24 are formed oppositely along the circumference of the seat hole 20.

As shown in FIG. 3, the back face of the watch main-body mounting seat 16 is provided with a guide groove-1 26 and a guide groove-2 28 extending counterclockwise from the notch-1 22 and the notch-2 24, respectively. Rising faces 26A and 28A are formed at the end of the guide groove-1 26 and the guide groove-2 28, respectively. An engaging projections-1 30 and an engaging projection-2 32, which are to enter into the notch-1 22 and the notch-2 24, respectively, are formed to protrude at the top and the bottom, respectively, on the back face of the watch main body 12. An engaging tab-1 30A and an engaging tab-2 32A extend laterally from the end of the engaging projections 30 and the engaging projections 32, respectively, and will slide along the guide groove-1 26 and the guide groove-2 28, respectively.

Pins 34 and 36 protrude diagonally on the back face of the watch main body 12, which fit into the corresponding cavities 40 and 42 (see FIG. 2) placed diagonally on the front face of the watch main-body mounting seat 16.

As shown in FIGS. 2 and 3, the watch main body 12 is further provided with bases 44 and 46, which serve to place it firmly upright.

Figure 5:
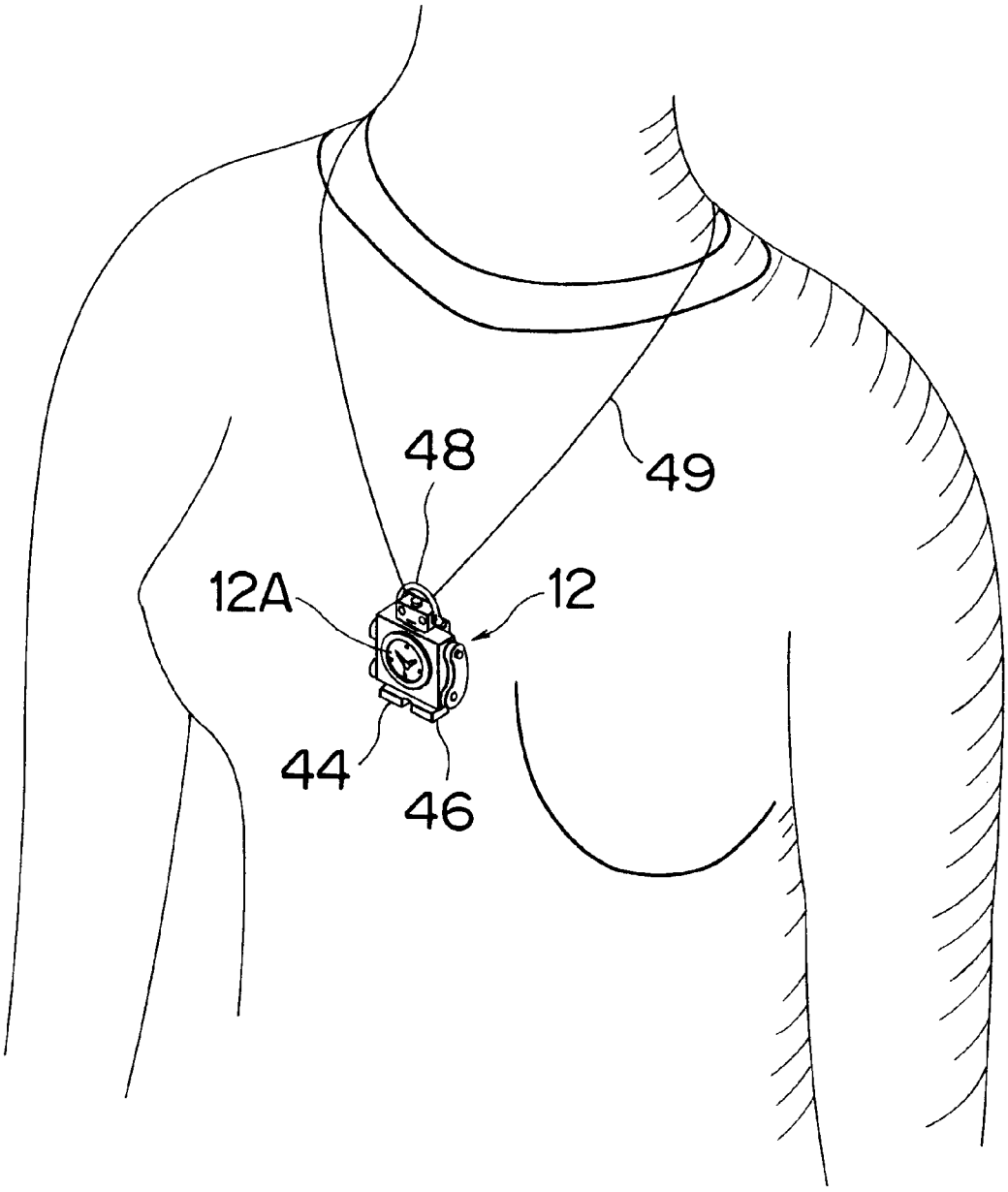
FIG. 5 is a perspective view of the entire watch main body, which is used as a pendant, of the watch that can serve as either a wristwatch or a clock in the first embodiment.

A ring 48 is provided on the top of the watch main body 12. As shown in FIG. 5, this ring 48 allows the use of the watch main body 12 as a pendant by slinging it from a person's neck with a chain 49, which can be purchased separately.

The functions of the first embodiment are described below.

The watch 10 that can serve as either a wristwatch or a clock can be fit on a person's wrist by extending the hand and wrist through the watchband 14 and fastening the adjuster 18. Thus, the watch 10 that can serve as either a wristwatch or a clock can be used as a wristwatch.

When a person turns the watch main body 12, while holding it, counterclockwise (in the direction marked by A in FIG. 1) until the engaging projections 30 and the engaging projections 32 reach the notch-1 22 and the notch-2 24, respectively, he/she can remove the watch main body 12 from the watchband 14 by pulling toward him/her. Then, when the person places the watch main body 12 on the surface of a table, etc., it firmly remains upright because of its bases 44 and 46. Thus, the watch 10 that can serve as either a wristwatch or a clock can be used as a clock.

Moreover, the watch main body 12 can be used as a pendant by slinging the ring 48 from the person's neck with a chain 49, as shown in FIG. 5.

In order to attach the watch main body 12 to the watchband 14, a person places the engaging projections 30 and the engaging projection-2 32 so as to face the notch-1 22 and the notch-2 24, respectively, while holding the watch main body 12, turn it clockwise (in the direction reverse to that marked by A in FIG. 1) for the engaging tab-1 30A and the engaging tab-2 32A to slide along the guide groove-1 26 and the guide groove-2 28, respectively, until the tab-1 30A and the tab-2 32A touch the rising faces 26A and 28A, respectively. At that moment, the pins 34 and 36 fit into the corresponding cavities 40 and 42, respectively; now, the watch main body 12 is fixed to the watchband 14.

Figure 6:
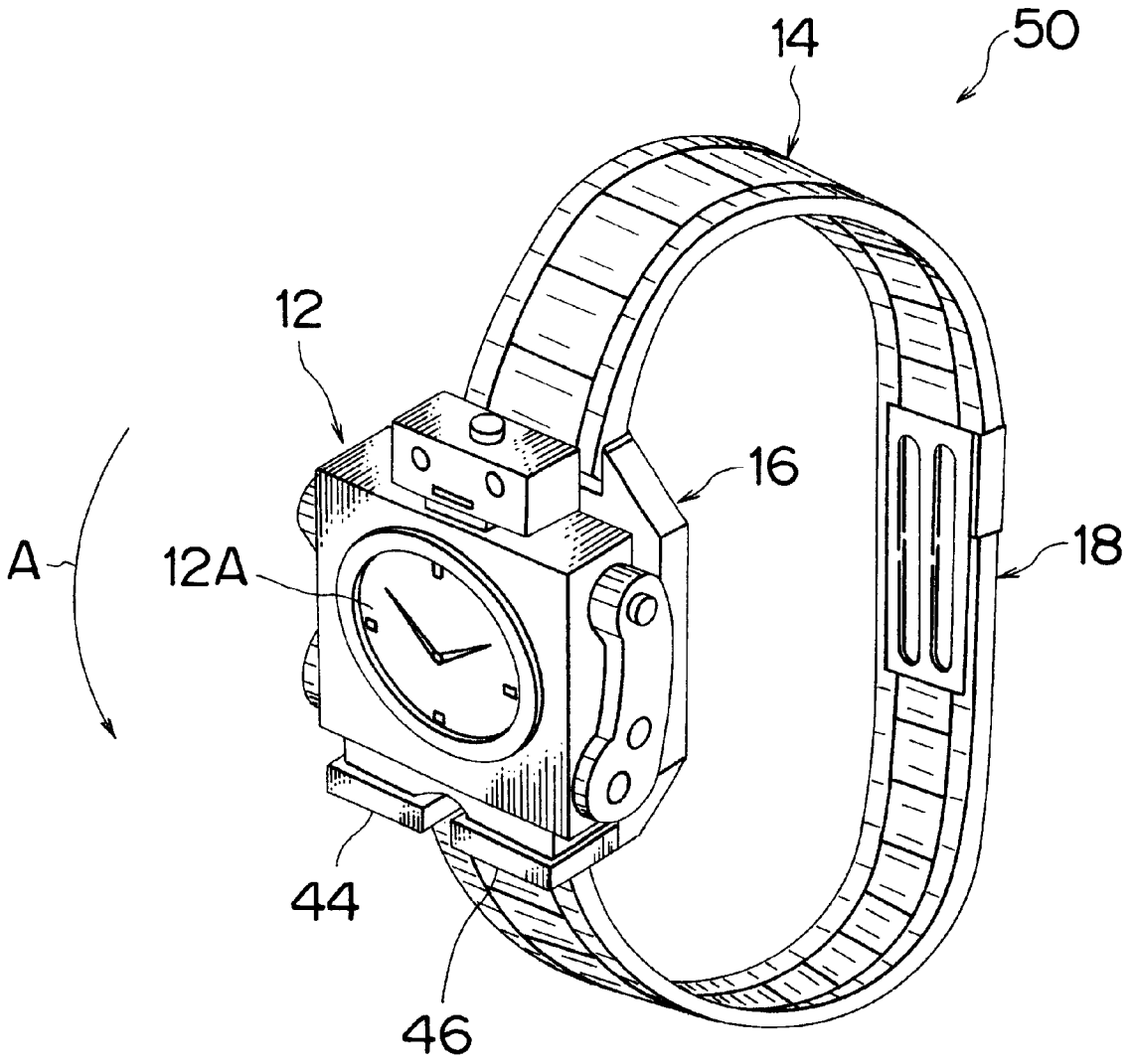
FIG. 6 is a perspective view of the entire watch that can serve as either a wristwatch or a clock in a second embodiment.

FIG. 6 illustrates a second embodiment of the device, a watch that can serve as either a wristwatch or a clock. In this embodiment, the same constituents as in the first embodiment are marked by the same symbols with their descriptions being omitted.

The watch main body 12 of the watch 50 that can serve as either a wristwatch or a clock lacks the ring 48. Therefore, the watch main body 12 in the second embodiment cannot be used as a pendant, but has an advantage of lower manufacturing cost because it has fewer components than the first embodiment. Other components and their functions are the same as in the first embodiment, and are not described here.

Figure 7:
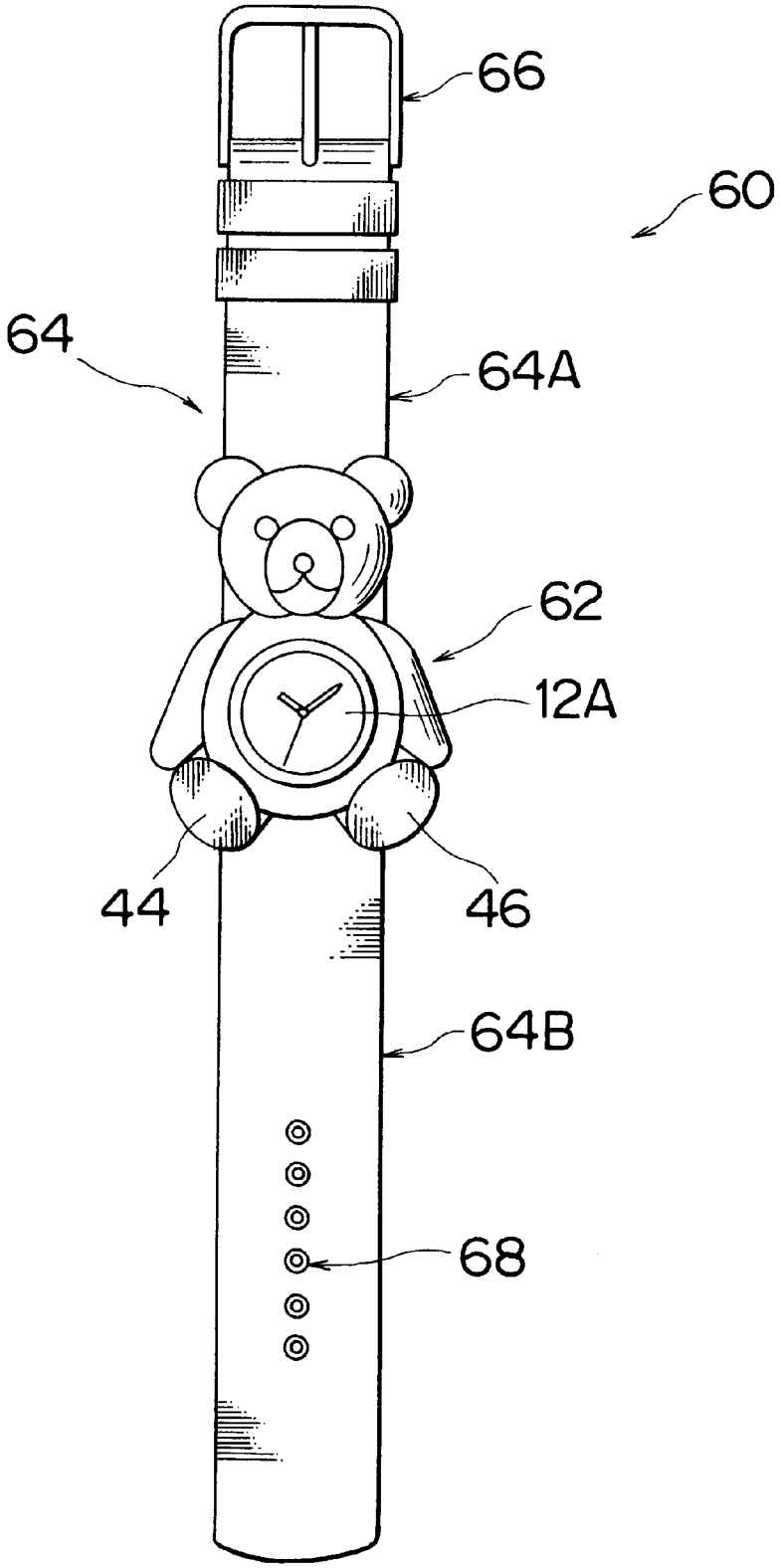
FIG. 7 is a front view of the watch that can serve as either a wristwatch or a clock in a third embodiment.

FIG. 7 illustrates a third embodiment of the device, a watch that can serve as either a wristwatch or a clock. In this embodiment 3, the same constituents as in the first embodiment are marked by the same symbols with their descriptions being omitted.

The watch main body 62 of the watch 60 that can serve as either a wristwatch or a clock is designed to mimic a bear. In the third embodiment, the watch main-body mounting seat 16 is made smaller than the watch main body 62, and cannot be seen from the front because it is hidden behind the watch main body 62. A half-watchband 64A, which has a buckle 66, is attached to one end of the watch main-body mounting seat 16; a half-watchband 64B, on which eyelets 68 are perforated, is attached to other end of the watch main-body mounting seat 16. The half-watchband 64A and the half-watchband 64B complete the watchband 64. Furthermore, like the second embodiment, the watch main body 62 of the watch 60 that can serve as either a wristwatch or a clock lacks the ring 48. Other components and their functions are the same as in the first embodiment, and are not described here.

In the first and second embodiments, the watch main body 12 is designed to mimic a robot, and in the third embodiment the watch main body 62 is designed to mimic a bear. However, the shapes of the watch main bodies 12 and 62 are certainly not restricted to robots and bears.

Although a pendant is shown in the first embodiment as an application of the watch main body 12 by slinging the ring 48 with a chain 49, the watch main body 12 certainly can be attached to a key holder, and other things through its ring 48.

Moreover, the ring 48 is absent on the watch main body 62 in the third embodiment. However, the watch main body 62 also can be fitted with a ring 48.

As described thus far, the device in the present invention, a watch that can serve as either a wristwatch or a clock, has such great effects that it can be used not only as a wristwatch, but also as a clock because its watch main body can be left firmly upright.

What is claimed is:

1. A watch that can serve as either a wristwatch or a clock comprising; a watch main body; a watchband detachable from the watch main body; a watch main-body mounting seat, which is part of the watchband; a seat hole at the center of the mounting seat; a notch 1 and a notch 2, which are oppositely formed along the circumference of the seat hole; a guide groove 1 and a guide groove 2, which are formed along the circumference of the seat hole extending from the notch 1 and the notch 2, respectively; an engaging projection 1 and an engaging projection 2, which protrude from the back face of the watch main body and are to enter into the notch 1 and the notch 2, respectively; an engaging tab 1 and an engaging tab 2, which form the end of the engaging projection 1 and the engaging projection 2, respectively, and are to be guided along the guide groove 1 and the guide groove 2, respectively; a base, which is part of the watch main body; and a ring provided on the watch main body.

2. A watch that can serve as either a wristwatch or a clock comprising; a watch main body; a watchband detachable from the watch main body; a watch main-body mounting seat, which is part of the watchband; a seat hole at the center of the mounting seat; a notch 1 and a notch 2, which are oppositely formed along the circumference of the seat hole; a guide groove 1 and a guide groove 2, which are formed along the circumference of the seat hole extending from the notch 1 and the notch 2, respectively; an engaging projection 1 and an engaging projection 2, which protrude from the back face of the watch main body and are to enter into the notch 1 and the notch 2, respectively; an engaging tab 1 and an engaging tab 2, which form the end of the engaging projection 1 and the engaging projection 2, respectively, and are to be guided along the guide groove 1 and the guide groove 2, respectively; and a base, which is part of the watch main body.

* * * * *